US010397993B2

(12) United States Patent
Marent

(10) Patent No.: US 10,397,993 B2
(45) Date of Patent: Aug. 27, 2019

(54) LED MODULE

(71) Applicant: Tridonic GmbH & Co KG, Dornbirn (AT)

(72) Inventor: Günter Marent, Bartholomaberg (AT)

(73) Assignee: Tridonic GmbH & Co KG, Dornbirn (AT)

( * ) Notice: Subject to any disclaimer, the term of this patent is extended or adjusted under 35 U.S.C. 154(b) by 0 days.

(21) Appl. No.: 15/038,564

(22) PCT Filed: Nov. 26, 2014

(86) PCT No.: PCT/AT2014/050283
§ 371 (c)(1),
(2) Date: May 23, 2016

(87) PCT Pub. No.: WO2015/077812
PCT Pub. Date: Jun. 4, 2015

(65) Prior Publication Data

US 2016/0302266 A1 Oct. 13, 2016

(30) Foreign Application Priority Data

Nov. 28, 2013 (AT) ..... GM401/2013
Dec. 16, 2013 (AT) ..... GM445/2013

(51) Int. Cl.
*H05B 33/08* (2006.01)
*H05B 37/02* (2006.01)

(52) U.S. Cl.
CPC ..... *H05B 33/083* (2013.01); *H05B 33/0815* (2013.01); *H05B 33/0842* (2013.01);
(Continued)

(58) Field of Classification Search
CPC ..... G01R 31/2635; G01R 31/2837; G05B 15/02; G05F 1/66; H05B 33/0803;
(Continued)

(56) References Cited

U.S. PATENT DOCUMENTS 5,592,051 A * 1/1997 Korkala ..... H02J 13/0003 315/210
2004/0056774 A1* 3/2004 Schleicher ..... H05B 33/0848 340/815.45

(Continued)

FOREIGN PATENT DOCUMENTS

DE 102008039530 A1 2/2010
EP 1244334 A2 9/2002

OTHER PUBLICATIONS

International Search Report and Written Opinion issued in connection with the corresponding International Application No. PCT/AT2014/050283 dated May 22, 2015.

(Continued)

*Primary Examiner* — Seokjin Kim
(74) *Attorney, Agent, or Firm* — The H.T. Than Law Group

(57) ABSTRACT

The invention relates to an LED module (1), comprising: connections (2) for an LED series (3); a circuit (4), which is designed to constitute a load, preferably an active-power load, when a first supply voltage (5*a*) not equal to zero is applied to the LED module (1), which active-power load is dimensioned in such a way that, when an LED series (3) is connected, said LED series is not conductive, and which is designed to constitute no load when a second supply voltage (5*b*) not equal to zero is applied to the LED module (1), for which second supply voltage, when an LED series (3) is connected, said LED series is conductive and light is emitted, wherein the type of load change is selected in dependence on the value of the first supply voltage and/or a modulation of the first supply voltage.

17 Claims, 12 Drawing Sheets

(52) U.S. Cl.
CPC ..... *H05B 33/0884* (2013.01); *H05B 37/0227* (2013.01); *H05B 33/0848* (2013.01)

(58) Field of Classification Search
CPC ..... H05B 33/0815; H05B 33/0821; H05B 33/083; H05B 33/0842; H05B 33/0845; H05B 33/0848; H05B 33/0851; H05B 33/086; H05B 33/0866; H05B 33/0884; H05B 33/089; H05B 33/0896; H05B 37/0227; H05B 37/0263

USPC .... 315/291, 307, 82; 307/18–20, 24, 31–34; 324/414, 403, 600, 602, 605, 606; 340/815.45, 693.1, 458, 333, 907, 908, 340/931, 286.02
See application file for complete search history.

(56) References Cited

U.S. PATENT DOCUMENTS

| | | | | |
|---|---|---|---|---|
| 2005/0062445 | A1 | 3/2005 | Toyota et al. | |
| 2011/0266969 | A1* | 11/2011 | Ludorf ..... | H02M 1/4258 315/294 |
| 2012/0119662 | A1* | 5/2012 | Radermacher ..... | H05B 33/0851 315/158 |
| 2015/0331436 | A1 | 11/2015 | Vonach | |

OTHER PUBLICATIONS

Search Report issued in connection with the corresponding application No. PCT/AT2014/050283.
Search report issued in connection with priority application GM 401/2013 dated Feb. 8, 2016.
Search report issued in connection with priority application GM 445/2013 dated Feb. 9, 2016.

* cited by examiner

LED MODULE

FIELD OF THE INVENTION

The present invention relates to an LED module, an LED converter and method which allow the communication of operating parameters of the LED module to the LED converter without a specific communications line between LED module and LED converter.

BACKGROUND OF THE INVENTION

From the prior art, several approaches to specifying operating parameters for a connected LED module to an LED converter are already known. This is therefore necessary, for example, because, for different LED modules, different let-through currents are necessary, in order to cause the LED series of the LED modules to illuminate. Operating parameters are, for example, a let-through current required or a set or let-through voltage to be applied.

One approach known from the prior art is to adjust the operating parameters to be set for the connected LED module in the LED converter via DIP-switches or resistors. However, an interaction with the LED converter is necessary for this.

In another approach, configuration resistors on the LED module are used to specify the required operating parameters to the LED converter. However, on the one hand, additional connections are necessary for this, on the other hand, an interaction is again required.

Communicating the necessary operating parameters to the LED converter via a separate digital signal channel is also known. However, for this, additional components must be installed, and an interaction is again necessary.

Finally, allocating to the LED module, for example, an EPROM from which the LED converter can determine information with regard to the operating parameters to be adjusted in the LED module is also known.

However, the approaches known from the prior art all require either an interaction with the LED converter or the LED module, or require additional connections or components. As a result, the costs of the LED module and/or of the LED converter are increased. Furthermore, more space is required for the components, which prevents a more compact construction.

SUMMARY OF THE INVENTION

The object of the present invention is to improve the prior art, in particular, with regard to the disadvantages named above. In particular, it is the object of the present invention to communicate (report back) information, for example, regarding operating parameters of an LED module, to an LED converter, without the need for additional components or connections, or an interaction. An object of the present invention is therefore to manufacture an LED module and an LED converter in a more cost-favourable and compact manner.

The objects of the present invention are achieved by the features of the independent claims. The dependent claims develop the core idea of the invention advantageously further.

The invention relates to a system, in which, through a generated load or load changes of the LED module, information can be communicated to the LED converter. For example, according to the present invention, in a preferably time-limited start phase, information can be communicated to the LED converter through a generated load or load changes of the LED module. Alternatively, or additionally, information can be exchanged according to the present invention between the LED converter and the LED module by means of a bidirectional communication, wherein the communication from the LED module are communicated via a generated load or load changes of the LED module.

In one embodiment, the present invention exploits the fact that, for the operation of an LED module, especially in order to cause an LED series of the LED module to illuminate, a given let-through voltage in the LED series, that is, a given supply voltage in the LED module is necessary.

Below the let-through voltage, the LED series is blocked. The LED series is therefore not conductive and constitutes an approximately infinite resistance for the LED converter. Only at or above the let-through voltage does the LED series constitute an active-power load for the LED converter. A supply voltage in an LED series which is not equal to zero but below the let-through voltage, defines a voltage window, in which the LED series is not yet conductive. This voltage window is used by the present invention in order to communicate information to the LED converter through a generated load or load changes of the LED module.

For example, the present invention relates to an LED module, which comprises: connections for an LED series, a circuit which is embodied to constitute a load, preferably an active-power load, when a first supply voltage not equal to zero is applied to the LED module, in which a connected LED series is not conductive, and which is embodied to constitute no load when a second supply voltage not equal to zero is applied to the LED module, at which a connected LED series is conductive. The load for the voltage window (readout window), in which the LED series is not conductive, causes a power consumption of the LED module.

For example, a circuit which is embodied to constitute a load, preferably an active-power load, can be activated in a preferably time-limited start phase. After the expiry of the preferably time-limited start phase, the circuit can be embodied to constitute no load. The load for the preferably time-limited start phase causes a power consumption of the LED module.

For example, the present invention relates to an LED module, which comprises: connections for an LED series, a circuit, which is embodied to constitute a load, preferably an active-power load when a first supply current not equal to zero is supplied to the LED module, and which is embodied to constitute no load when a second supply current not equal to the first supply current is supplied to the LED module or when a preferably time-limited start phase has expired. The load for the voltage window (readout window), in which the LED series is not conductive, causes a power consumption of the LED module.

An LED converter can detect this power consumption and, based on the detected power consumption, can determine parameters of the LED module. For example, the LED converter can infer operating and/or maintenance parameters of the LED module to be adjusted from the detected power consumption, for example, based on stored tables.

According to one embodiment, the circuit is preferably embodied to be activated every time when a supply voltage is applied to the LED module. Furthermore, the circuit is designed to deactivate itself automatically, when a preferably time-limited start phase has expired or respectively ended. Accordingly, in the continuous lighting mode of the LED series, no power loss is present. In order to activate the circuit, no additional connections are necessary. The circuit can be integrated in the LED module and need not be supplied as a separate component. The circuit functions automatically after application of a supply voltage, that is, of a start phase, accordingly, no additional interaction needs to be implemented.

According to one embodiment, the circuit is preferably embodied to be activated every time when a supply voltage between zero and the let-through voltage of the LED series is applied to the LED module. Furthermore, the circuit is designed to deactivate itself automatically when the supply voltage applied reaches or respectively exceeds the let-through voltage of the connected LED series. Accordingly, in the lighting mode of the LED series, no power loss is present. In order to activate the circuit, no additional connections are necessary. The circuit can be integrated in the LED module and need not be supplied as a separate component.

The circuit functions automatically according to the supply voltage applied, and accordingly, no additional interaction needs to be implemented.

As an alternative to the application of a supply voltage with a value between zero and the let-through voltage of the LED series, a specified supply current can also be fed into the LED series for the activation of the circuit, in order to activate the circuit on the LED series. For example, the LED converter can output the nominal, minimal output current according to its specification or a low minimal current value, at which it is ensured that the LED module is not overloaded. In this case, the circuit is designed to deactivate itself automatically, for example, when the supply current fed in reaches or exceeds the rated current of the connected LED series or when a preferably time-limited start phase has expired.

By preference, the circuit is embodied to constitute a constant-current or constant-power load, which causes a constant current consumption or a constant power consumption of the LED module.

The circuit is therefore a constant load capable of being activated selectively within the readout window of the supply voltage. Such a circuit allows a particularly simple embodiment of the present invention.

Alternatively, the circuit is designed to constitute a variable-current load, which causes a change in the power consumption of the LED module according to at least one specified protocol.

Through a variable power consumption, that is, a load change of the module in the readout window, more complex information can be constituted.

By preference, the circuit is designed to code at least one operating and/or maintenance parameter of the LED module through the change in the power consumption according to the at least one specified protocol.

Additionally, or alternatively, the circuit can also be embodied on the LED module in such a manner that it is preferably activated only in a time-limited start phase of the LED module.

An LED converter can register the change in the power consumption of the LED module and decode it according to the at least one protocol, which is stored, for example in the LED converter. A communication path from the LED module to the LED converter is therefore made possible without additional lines or pins. Operating parameters of the LED module can be, for example, the let-through current for an LED series of the LED module, the corresponding let-through voltage of the LED series, a set current of the LED module, or a spectrum of the light emitted by the LED series. Maintenance parameters can be, for example, ageing parameters of the LED module or respectively of the LED series, an operating time of the LED module or a temperature in the LED module.

By preference, the at least one specified protocol specifies a frequency and/or an amplitude and/or a duty factor of the change in the power consumption of the LED module.

The at least one protocol can therefore be coded in multiple ways, namely, with regard to a frequency of the power consumption, an amplitude, and a switch-on clocking. Accordingly, complex information can be coded. Several differently coded protocols can also be used.

By preference, the circuit is designed in such a manner that the change in the power consumption of the LED module is independent of a value of the first supply voltage.

The circuit on the LED module accordingly reproduces the coding parameters (for example, amplitude, frequency, duty factor of the load change) in the readout window (that is, supply voltage not equal to zero but below the let-through voltage of the LED series) independently of the supply voltage.

As a result, only a constant, but not a precise, voltage specification needs to be adjusted in this readout window of the supply voltage.

Alternatively, the circuit is designed in such a manner that the change in the power consumption of the LED module is caused dependent upon a value of the first supply voltage according to one of several specified protocols.

According to this embodiment of the invention, with the application of a supply voltage within the readout window, the same response information is not transmitted constantly to an LED converter, which is connected to the LED module as described above. On the contrary, the voltage range of the supply voltage, at which a connected LED series is not yet conductive, can be subdivided into several sub-ranges of the supply voltage. For every sub-range, a different specified protocol can apply. This means that, in every sub-range, a different change in the power consumption can take place (that is, different in frequency of the power-consumption change, the amplitude of the power-consumption change or the duty factor, dependent upon supply voltage applied). As a result, different information can be communicated back to the LED converter. In this context, more complex protocols are also conceivable, which, for example, comprise the modulation of the supply voltage, a selective switching on and switching off of the supply voltage between zero and a voltage within the readout window and so on. In order to subdivide the range of the information transmission even further, frequency modulations, amplitude modulations or PWMs of the supply voltage are also conceivable.

By preference, the circuit comprises a timer circuit, which is designed to specify a frequency of the change in power consumption of the LED module. The timer circuit therefore specifies the frequency of the load change of the LED module.

By preference, the circuit is integrated in a semiconductor material of the LED module. Accordingly, the circuit can be embodied in a particularly space-saving and cost favourable manner.

Advantageously, at least one sensor is provided on the LED module, which is designed to influence an electrical parameter of the circuit.

The at least one sensor can be, for example, a sensor or a combination of sensors, which can be light sensors, temperature sensors, colour sensors and so on. The influenced electrical parameters of the circuit on the LED module can be, for example, a resistance value or a conductivity.

By preference, the at least one sensor is a light sensor with light-dependent resistor, and the light sensor is connected to the circuit in such a manner that a change of the light-dependent resistor changes the load resistance of the circuit.

A light sensor with light-dependent resistance (that is, a "Light Dependent Resistor") is readily realised. A luminous power which strikes this resistor directly influences its resistance value and therefore also the active-power load of the circuit within the readout window.

The present invention further relates to an LED converter for an LED module as described above, which is designed to register a power consumption of the LED module for a first supply voltage present in the LED module, at which an LED series connected to the LED module is not conductive, and, based on the registered power consumption, to determine at least one operating and/or maintenance parameter of the LED module.

Through the registered power consumption, the necessary information is transmitted to the LED converter in order to determine the operating and/or maintenance parameter. The LED converter can determine these parameters, for example, based upon one or more stored or buffered tables, which correlate, for example, the operating and/or maintenance parameters with constant or variable power consumptions within the readout window.

By preference, the LED converter is designed to use the at least one determined operating and/or maintenance parameter: for adjustment or control of the operation of the LED module, for storage in an associated memory, for visual and/or acoustic display, and/or for transmission via a wireless or tethered interface, optionally upon request from externally.

The LED converter is accordingly suitable for comprehensive control of the LED module. For this purpose, no separate communication path or additional lines or respectively pins are necessary between the LED module and the LED converter. The information transmission, for example, the transmission of the operating and/or maintenance parameters, takes place via the connections already present anyway for the supply voltage.

Advantageously, the at least one operating and/or maintenance parameter is a set current through an LED series connected to the LED module, an ageing parameter, an operating duration, and/or a spectrum of a light emitted by the LED series.

Advantageously, the LED converter is designed to identify the LED module based upon the at least one determined operating and/or maintenance parameter.

The identification can be implemented, for example, on the basis of one or more stored tables. When the LED converter has identified the LED module, further information can be stored in the one or more tables, which allow a comprehensive control of the LED module. In particular, a let-through current of the LED series of the LED module is advantageous as stored information.

Advantageously, the LED converter is designed to signal to the LED module by changing the supply voltage of the LED module, for example, via a pulse or amplitude modulation of the supply voltage, to change selectively into a mode in order to change the power consumption of the LED module (load change). In this context, the modulation of the supply voltage can take on different patterns or values, wherein a targeted selection of individual LED modules can be made possible, if one LED converter supplies several LED modules. The LED module respectively selected in this manner can then selectively change into the mode for the load change in order to transmit information to the LED converter. The several LED modules can be arranged in a series configuration or parallel configuration. The LED converter can be designed for this purpose, by changing the supply voltage, for example, via a pulse or amplitude modulation of the supply voltage, dependent upon the respective pattern or value, to request different types of information from the LED module or modules. Various tables for the acknowledgement of the different information can be stored for this purpose in the LED module.

For example, through adjustment of a first supply voltage or a second supply voltage for the LED module, the LED converter is designed to change selectively between a mode for the registration of a power consumption of the LED module and a mode for the lighting operation of an LED series connected to the LED module.

The first supply voltage in this context is a voltage within the readout window, that is, a supply voltage between zero and a let-through voltage, at which the connected LED series is still not yet conductive. The second supply voltage is a voltage above the let-through voltage, at which the connected LED series is conductive, preferably illuminates. The LED converter is therefore automatically set into the corresponding mode based on the adjusted supply voltage. A registration of the power consumption takes place only in the named registration mode.

As a result, it is possible to switch off registration circuits of the converter in the lighting mode and to save energy. An interaction with the LED converter from the externally is not necessary for the change of the mode.

By preference, the LED converter is designed to implement a current measurement for the direct registration of the power consumption of the LED module.

Alternatively, the LED converter is designed to implement an indirect registration of the power consumption of the LED module.

By preference the LED converter is designed to register a change in the power consumption of the LED module through a change in the duty factor of the clocking of the LED converter, for example, of a buck converter (also known as a stepdown converter) or of an isolated flyback converter (flyback converter).

Dependent upon the control concept for an LED module, the LED converter can also register a change of the peak current in the LED converter, for example, in an isolated converter, preferably an isolated flyback converter.

Advantageously, the LED converter is designed to discharge a capacitor via a load of the LED module, to determine a discharge current of the capacitor directly or indirectly via the discharge time and to determine the at least one operating and/or maintenance parameter of the LED module based on this discharge current.

In particular, this embodiment of the LED converter is preferably used for an LED module with constant-current load in the range of the readout window of the supply voltage. In this context, a capacitor in the LED converter is discharged, for example, via a constant current sink on the LED module, wherein the discharge current flowing in this context can be measured directly or indirectly via a discharge rate (negative gradient) of the voltage of the capacitor.

The directly or indirectly registered discharge current can then be interpreted by the LED converter with regard to the operating and/or maintenance parameter. The information about the operating and/or maintenance parameter is therefore coded in the gradient of the voltage, which the LED converter outputs when the capacitor is discharged. The measurement of the discharge rate eliminates the dependence upon the absolute supply voltage. A detection of the discharge current via the discharge duration of the capacitor is also conceivable. For this purpose, the information about the absolute voltage at the beginning and the end of the measurement, that is, with the discharge of the capacitor, can also be present or can be fed back to the LED converter.

The present invention further relates to an LED luminaire comprising an LED module, as described above, and an LED converter, as also described above.

The present invention further relates to a method for the communication of information from an LED module to an LED converter, which comprises: activation of a circuit, in order to constitute a load, preferably an active-power load, when a first supply voltage not equal to zero is applied to the LED module, at which a connected LED series is not conductive, and deactivation of the circuit in order to constitute a load when a second supply voltage not equal to zero is applied to the LED module, at which a connected LED series is conductive.

The present invention also relates to a method for determining information regarding an LED module in an LED converter, which comprises: registration of a power consumption of the LED module for a first supply voltage applied to the LED module, at which an LED series connected to the LED module is not conductive, and determination of at least one operating and/or maintenance parameter of the LED module based on the registered power consumption.

Furthermore, the present invention relates to a method for the communication of information from an LED module to an LED converter comprising a high-frequency clocked converter with a transformer, which comprises an activation of a circuit at least during a time-limited start phase in order to constitute a load, preferably an active-power load, and a registration of a power consumption of the LED module on the primary side of the transformer of the high-frequency clocked converter.

The present invention also relates to a method for determining information relating to an LED module in an LED converter comprising a high-frequency clocked converter with a transformer, which comprises a registration of a power consumption of the LED module on the primary side of the transformer of the high-frequency clocked converter, wherein a circuit on the LED module causes a modulated load change at least during a start phase, and determination of at least one operating and/or maintenance parameter of the LED module based on the registered power consumption.

In total, the present invention allows information regarding operating and/or maintenance parameters to be adjusted in an LED module to be communicated to an LED converter. In this context, no further terminals or connection is/are necessary between LED converter and LED module. No further components are necessary apart from a load modulation circuit, advantageously integrated in a semiconductor material of the LED module. No additional interaction with LED module or the LED converter needs to be implemented for the transmission of the information. The present invention therefore allows a simpler control of an LED module and a more cost favourable and compact manufacture of LED module and/or LED converter.

The present invention also relates to a method for determining information with regard to an LED module in an LED converter, which comprises a registration of a power consumption of the LED module, wherein a circuit on the LED module causes a modulated load change at least during a start phase, and determination of at least one operating and/or maintenance parameter of the LED module based on the registered power consumption.

BRIEF DESCRIPTION OF THE DRAWINGS

The present invention is now described in greater detail with reference to the attached Figures.

DETAILED DESCRIPTION OF THE PREFERRED EMBODIMENTS

Figure 1:
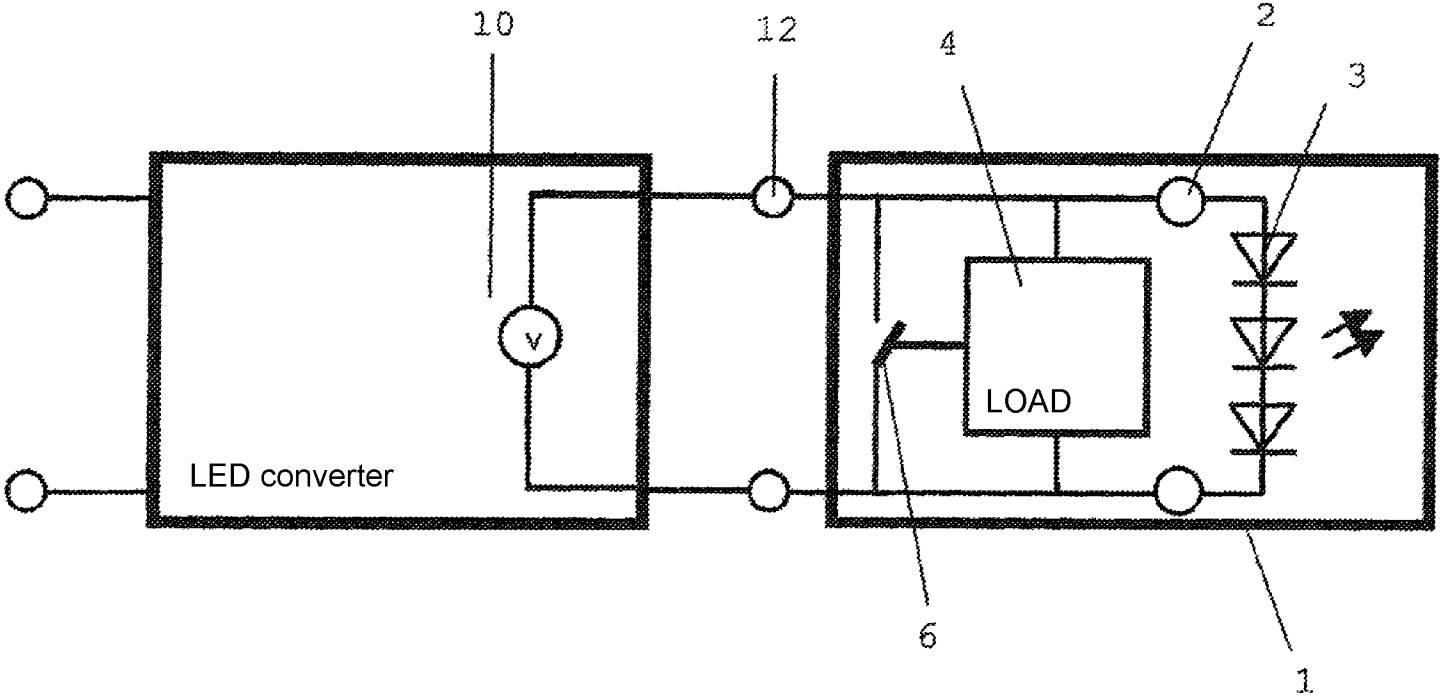
FIG. 1 shows schematically the basic principle of the present invention on the basis of an LED luminaire according to the invention (comprising an LED module according to the invention and an LED converter according to the invention).

FIG. 1 shows schematically an LED luminaire according to the invention, which comprises an LED module 1 according to the invention and an LED converter 10 according to the invention. The LED converter 10 is connected via one or more voltage connections 12 to the LED module 1. The LED converter 10 therefore supplies the LED module 1 with a supply voltage. The LED converter 10 can also be designed for the operation of several LED modules 1. By preference, the supply voltage is a DC voltage, but can also be a clocked voltage or AC voltage. The LED converter 10 preferably comprises a high-frequency clocked converter, for example, a buck converter (stepdown converter), isolated flyback converter (flyback converter) or a resonant half-bridge converter (preferably isolated, for example, an LLC converter). The LED converter 10 can output, for example, a constant output voltage or a constant output current to its voltage connections 12, wherein the voltage at these connections corresponds to the supply voltage of the LED module 1.

The supply voltage is applied via one or more connections 2 of the LED module 1 to at least one LED series 3 connected to it (this also comprises an individual LED). The LED series 3 need not be a part of the LED module 1 according to the invention, but can be a connectable and replaceable LED series 3. The LED module 1 according to the invention therefore requires only connections 2 for at least one LED series 3. The LED series 3 can, however, also be rigidly assembled with the LED module 1. The LED series 3 can comprise one or more LEDs, which are connected in series, for example, as shown in FIG. 1. LEDs of an LED series 3 can all illuminate in the same colour, that is, emit light of the same wavelength, or illuminate in different colours.

For example, several LEDs, preferably red, green and blue illuminating LEDs, can be combined in order to generate a mixed radiation of preferably white light.

When it is connected to the connections 2, the LED series 3 is configured in parallel with a circuit 4 with reference to the supply voltage. The circuit 4 is embodied, for example, in such a manner that it constitutes a load, preferably an active-power load, for the LED converter 10, when the supply voltage applied from the LED converter 10 to the connections 12 is not equal to zero, but is still no low that the LED series 3 connected to the connections 2 is still not conductive. The circuit 4 can therefore also be designated as a load circuit or load-modulation circuit.

Figure 2:
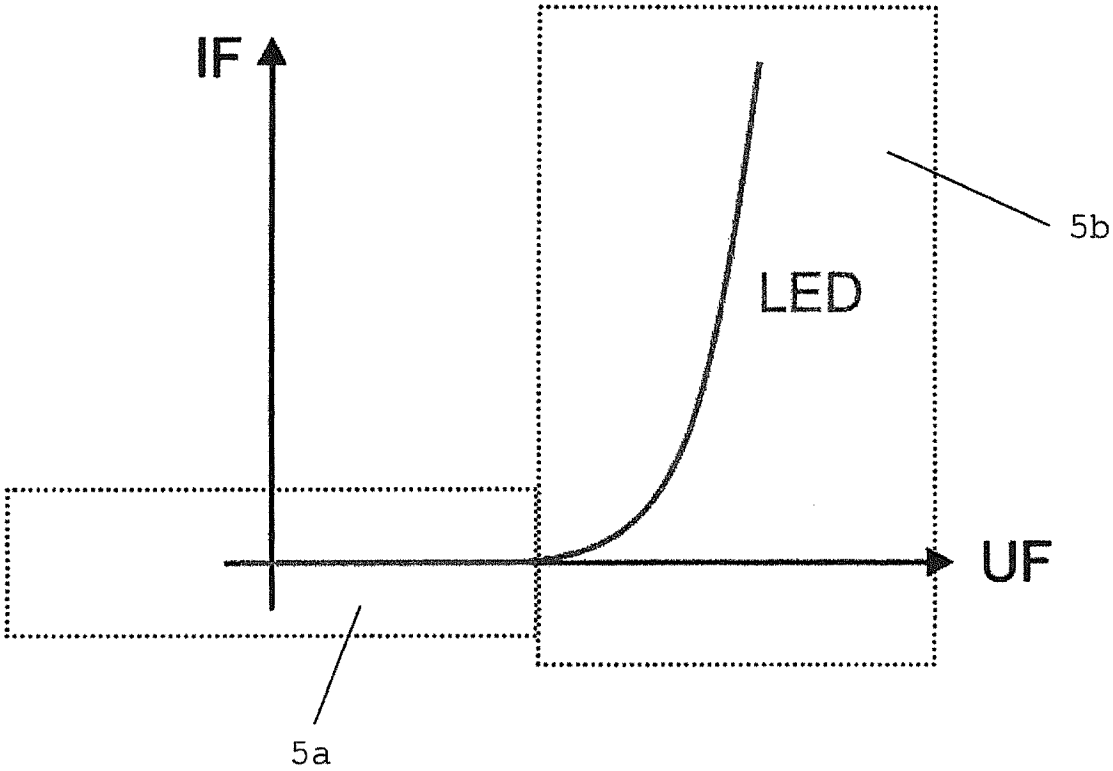
FIG. 2 shows a current-voltage characteristic of an LED series and the readout window according to the invention.

FIG. 2 shows by way of example a current-voltage characteristic of an LED series 3, in which a current through the LED series is plotted in the vertical direction, and the voltage in the LED series (that is, the supply voltage in FIG. 1) is plotted in the horizontal direction. For a first voltage range (that is, a first supply voltage 5*a* within the readout window), the voltage in the LED series 3 is not equal to zero, however, the current through the LED series 3 is also still close to zero, because the LED series 3 is not conductive. The supply voltage is therefore below the let-through voltage. The LED series 3 constitutes an infinite load for the LED converter 10. Accordingly, the LED module 1 consumes no power via the LED series 3. Within a second voltage range (that is, for a second supply voltage 5*b* outside the readout window), the LED series 3 is conductive, and a current flows through the LED series 3, which causes the latter to illuminate. The supply voltage is therefore above the let-through voltage.

The circuit 4 is embodied on the LED module 1, for example, in such a manner that it is activated when the first supply voltage applied, and accordingly constitutes a load, preferably an active-power load, for the LED converter 10. For the second supply voltage 5*b*, that is, in the lighting mode of the LED series 3, the circuit 4 is deactivated and does not constitute a load for the LED converter.

This is illustrated schematically in FIG. 1 by the switch 6, which automatically activates or deactivates the circuit 4 dependent upon the supply voltage applied. The circuit 4 can constitute either a constant-current load or a variable-current load for the LED converter 10. The circuit 4 causes a power consumption of the LED module 1, although an LED series 3 is still not yet conductive and consumes no power. A conventional LED module 1 would consume no power within the readout window. Additionally, or alternatively, the circuit 4 can also be embodied on the LED module 1 in such a manner that it is only activated in a time-limited start phase of the LED module 1.

The power consumption of the LED module 1 in the readout window can be constant-current or variable-current dependent upon the type of the circuit 4. The LED converter 10 can register the power consumption of the LED module 1 or respectively a change in the power consumption of the LED module 1 and, based on the registered power consumption, infer operating and/or maintenance parameters of the LED module 1 to be adjusted. The LED converter 10 can use the operating and/or maintenance parameters directly for the adjustment or control of the LED module 1. The LED converter 10 can, however, also store the operating and/or maintenance parameters in a memory allocated to it and optionally use them later, or display the parameters visually and/or acoustically to a user, or transmit them to a further device, for example, a control unit of a lighting system. The transmission can occur either in a wireless or in a tethered manner and can be implemented either automatically or only upon request from the further device.

In order to operate an LED module 1, different procedures can be implemented by the LED converter 1 of the present invention in a preferably time-limited start phase of the LED luminaire. Initially, the LED converter 10 supplies the LED module 1, for example, with a constant supply voltage, preferably a constant DC voltage. The LED converter 10 can be operated, for example, with reduced pulse control factor by comparison with the normal operation, thereby achieving lower output voltage. In this context, the supply voltage is a first supply voltage 5*a*, that is, it is disposed within the readout window which is shown in FIG. 2. Since the first supply voltage 5*a* is not equal to zero, the circuit 4 on the LED module 1 is activated and constitutes a load for the LED converter 10. The load is preferably an active-power load and generates a power consumption of the LED module 1. Now, the LED converter 10 can, for example, measure a discharge current of a capacitor via this load, an absolute current consumption of the circuit 4, a frequency of a change in the power consumption of the LED module 1, or a duty factor or an amplitude of a power-consumption change. Based on the result of the measurement, the LED converter 10 can infer operating and/or maintenance parameters.

For example, the LED converter 10 can determine a set or let-through voltage or a set current of the LED module and apply the latter to the LED module 1. Accordingly, a connected LED series 3 becomes conductive, and the LED converter 10 operates the LED module 1 in the lighting mode. The circuit 4 is now preferably automatically deactivated. Accordingly, the circuit 4 consumes no power in the lighting mode of the LED series 3 and therefore does not influence lighting mode of the LED series 3. The LED converter 10 of the LED luminaire has therefore automatically detected the LED module and adjusted the matching operating parameters.

Alternatively, or additionally, a reading out of the LED module 1 by the LED converter 10 can also take place in a time-limited manner, in that the circuit 4 is active only during a start phase because of a specified time span, as soon as a supply voltage is applied to the LED module 1. In this case, this supply voltage can also correspond to the nominal output voltage of the LED converter 10 for the normal mode. After the application of the supply voltage, the circuit 4 is activated on the LED module 1 and constitutes a load for the LED converter 10. The load is preferably an active-power load changing repeatedly and generates a power consumption of the LED module 1. Additionally, in this case, the connected LED series 3 can also become conductive, wherein the LED converter 10 operates the LED module 1 in the lighting mode.

Now, the LED converter 10 can, for example, measure a discharge current of a capacitor across this load, an absolute current consumption of the circuit 4, a frequency of a change in the power consumption of the LED module 1, or a duty factor or an amplitude of the power consumption change.

Based on the result of the measurement, the LED converter 10 can infer operating and/or maintenance parameters. For example, the LED converter 10 can determine a set or let-through voltage or a set current of the LED module and apply the latter to the LED module 1. By preference, the circuit 4 is now automatically deactivated after the expiry of the specified time span for the start phase. The specification of this time span for the start phase can be established, for example, through a time-charge circuit, wherein a timer-capacitor is charged up and, the circuit 4 is deactivated after the completed charging of the timer-capacitor. Accordingly, the circuit 4 consumes no power in the continuous lighting mode of the LED series 3 and therefore does not influence the lighting mode of the LED series 3.

Figure 3:
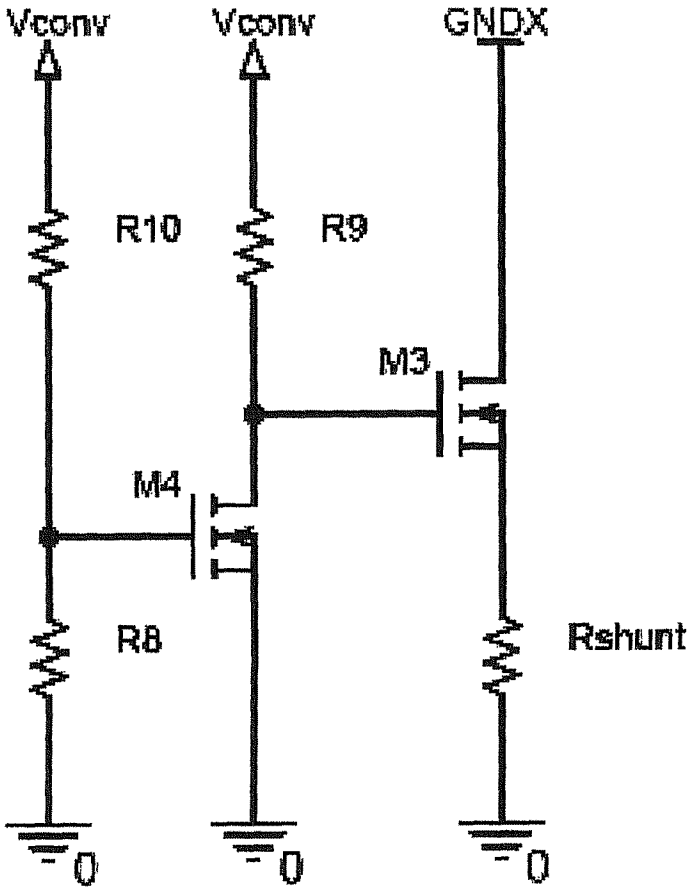
FIG. 3 shows an integrated circuit which allows an automatic deactivation of the circuit on the LED module according to the invention.

FIG. 3 shows an integrated circuit which is at least a part of the circuit 4 in order to activate the latter automatically when the supply voltage is within the range of the second supply voltage 5*b*, that is, above the let-through voltage of the LED series 3. The circuit 4 can be deactivated by means of the transistors M4 and M3. With rising supply voltage, which is delivered by the LED converter 10 and is present in the circuit 4 on the LED module 1, the voltage in the resistor R8 also rises. When this voltage reaches a threshold voltage of the transistor M4, the latter closes and also deactivates the transistor M3 by connecting the gate voltage of the transistor M3 to ground. The threshold voltage can be, for example, 1.4 V (in the case of a voltage of 12.5 V) of the LED converter 10). In order to reduce losses of the voltage splitter R8 and R10, the resistance values should be high, preferably within the range from 20 to 200 k□, by greater preference within the range from 40 to 100 k□. Furthermore, it is important that the transistor M3 is designed to withstand the maximal supply voltage which the LED converter 10 can apply, and that the voltage in the resistor R8 does not exceed the maximal permitted gate voltage of the transistor M4 in the case of normal lighting mode of the LED series 3. Alternatively, or optionally, this circuit can be designed, for example, by means of an RC element, in such a manner that, after the expiry of a specified start time (wherein this time corresponds to the start phase), it is deactivated, in that the transistor M3 is deactivated, that is, opened, independently of it. For example, a capacitor can be arranged in parallel to the resistor R8. This capacitor can be designed in such a manner that, after the expiry of the specified start time, the latter is charged by the applied supply voltage, and accordingly, the voltage in the parallel resistor R8 has also risen so far that the voltage has readied a threshold voltage of the transistor M4, so that the latter closes and deactivates the transistor M3 by connecting the gate voltage of the transistor M3 to ground.

Figure 4:
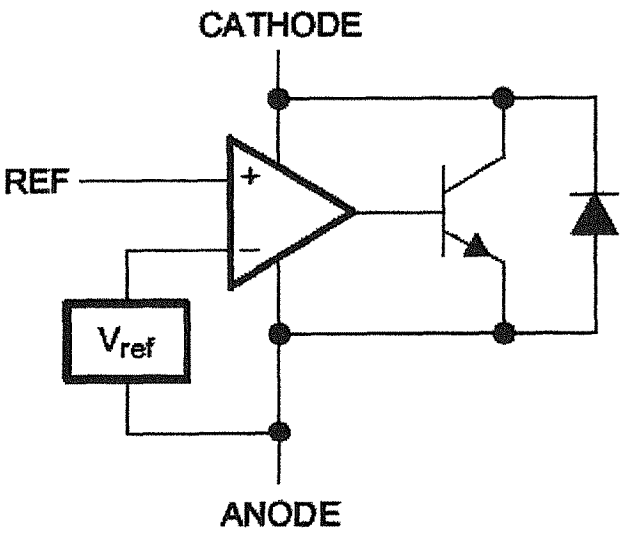
FIG. 4 shows an example of the circuit on the LED module according to the invention which constitutes a constant-current load.
Figure 4:
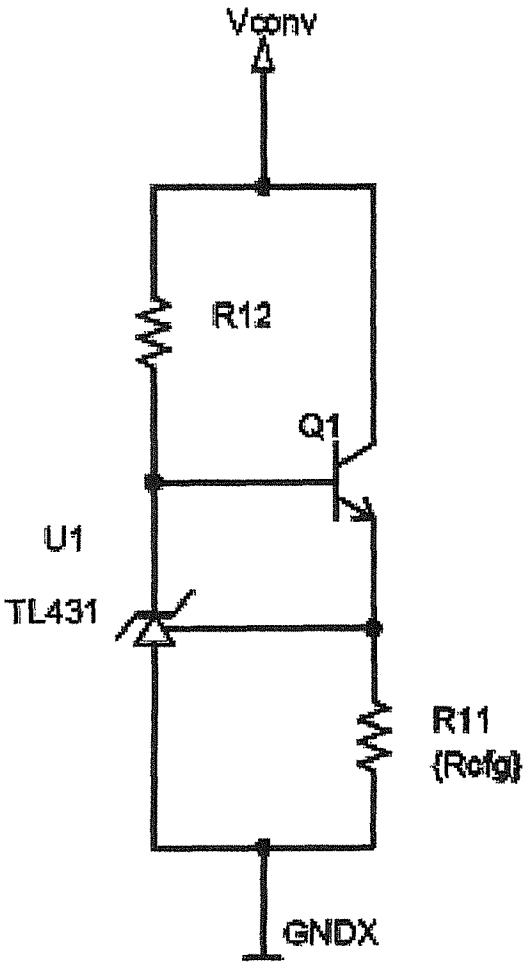

FIG. 4 shows, by way of example, an integrated circuit TL432, which is at least a part of the circuit 4, which is designed to constitute a constant-current load for the LED converter 10 in the readout window. The left side of the FIG. 4 shows a circuit diagram of the integrated circuit; the right side shows a corresponding equivalent circuit diagram for the integrated circuit TL431 or TL432. The constant current is determined by a ratio of the reference voltage of the integrated circuit TL431 to the resistance value of the selection resistor R11 (Rcfg). A transistor Q1 is preferably controlled in such a manner that the voltage in the resistor R11 (Rcfg) is always approximately 2.5 V. A minimal current of approximately 1 mA should flow through the integrated circuit TL431. The integrated circuit shown in FIG. 3 can be arranged in series with the integrated circuit shown in FIG. 4, so that the series circuit comprising both is arranged parallel to the LED series on the LED module 1.

By preference, the virtual ground GNDX of the integrated circuit of FIG. 4 is connected to the drain connection of the transistor M3.

Via a constant-current load, such as is shown in FIG. 4, the LED converter 10 can, for example, discharge a capacitor 11 for the measurement of the constant current. The constant current through the circuit 4 (which corresponds to the discharge current of the capacitor 11) can be determined directly or indirectly based upon either the discharge duration and/or the discharge rate. Based on the discharge current, the LED converter can infer the circuit 4 used and therefore the LED module 1 connected. Furthermore, the LED converter 10 can determine operating and/or maintenance parameters of the LED module, for example, on the basis of stored tables.

Figure 5:
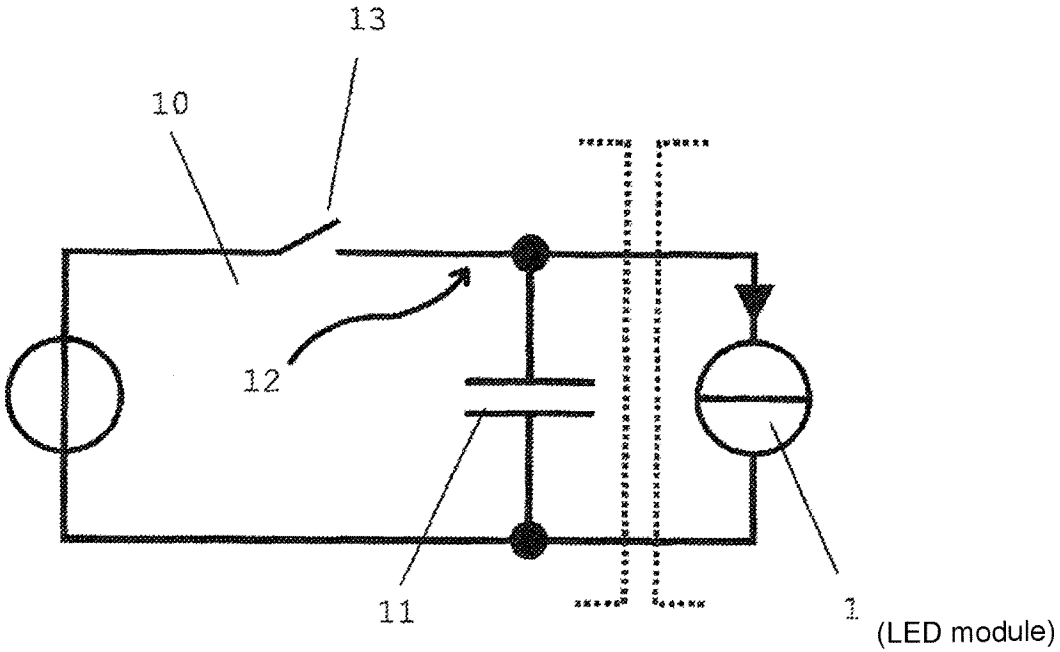
FIG. 5 shows schematically the registration of a constant-current load on the LED module according to the invention through the LED converter according to the invention.

The concept for determining the constant current through the circuit 4 is illustrated schematically in FIG. 5. For example, the LED converter 10 can be embodied, by way of example, as a buck converter. The LED converter 10 is provided with the capacitor 11, which can be connected parallel to the connections 12 for the supply voltage. The voltage at the connections 12 is monitored by the LED converter 10. If the supply voltage is separated from the LED module by opening the switch 13, which is arranged in the LED converter 10 and preferably clocked in a high-frequency manner during operation of the LED converter, the capacitor 11 is discharged via the preferably constant-current load, which is constituted by the circuit 4 on the LED module 1. The discharge rate, that is, the change of the voltage of the capacitor, which is present at the connections 12, is preferably measured by the LED converter 10 in order to infer the operating and/or maintenance parameters of the LED module 1, as described. For example, the resistor R 11, of the constant-current load shown in FIG. 4 can be determined, if the capacitance of the capacitor 11 is known. This resistance value can then encode the operating and/or maintenance parameter, that is, the LED converter 10 can, for example, correlate this resistance value with operating and/or maintenance parameters in buffered tables.

Figure 6:
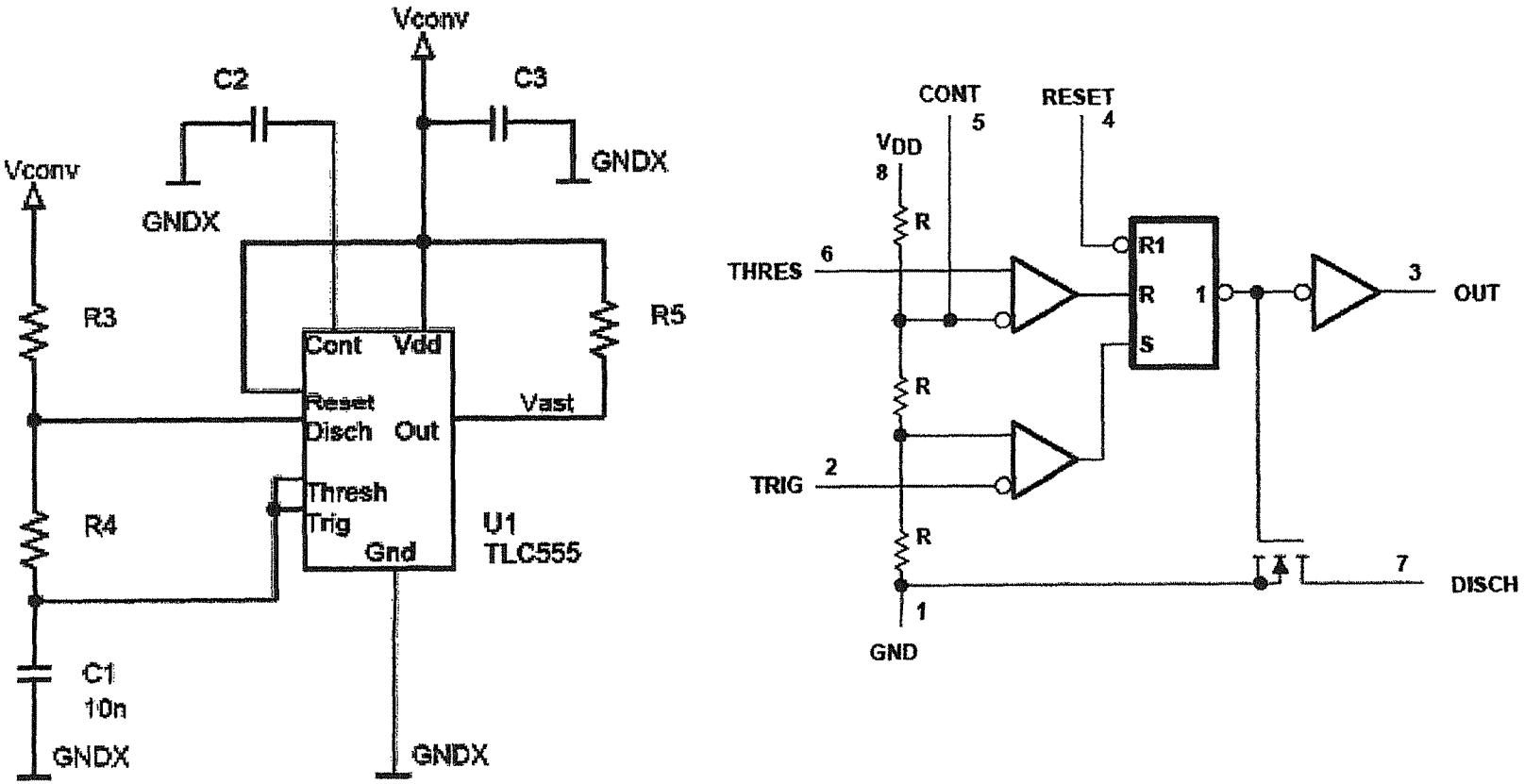
FIG. 6 shows a circuit on the LED module according to the invention, which constitutes a variable-current load and, in particular, adjusts a frequency of the change in the power consumption of the LED module according to the invention.

FIG. 6 shows an integrated circuit TLC555, which is at least a part of the circuit 4 and is suitable for generating a load change of the LED module 1 with a given frequency, that is, a change in the power consumption of the LED module 1. On the left side of FIG. 6, a circuit diagram is shown, on the right side a corresponding equivalent circuit diagram is shown for the integrated circuit TLC555. For example, a capacitor C1 can be charged and discharged between ⅓ and ⅔ of the supply voltage 5*a* applied by the LED converter. So long as the supply voltage 5*a* applied from the LED converter 10 is constant, a frequency of the load change, a duty factor (clock ratio) of the load change or an amplitude of the load change (that is, a difference between a load before and a load after the change) can be adjusted. This also determines a change in the power consumption with a corresponding frequency, duty factor (clock ratio) or an amplitude.

The frequency f of the change is defined in this context as $$f=1/\{R3+2\cdot R4)C1\cdot\ln(2)\},$$

Wherein R3, R4 and C1 are resistance and respectively capacitance values of the components shown in FIG. 6.

The duty factor (clock ratio) is defined by the ON time ($T_{high}$) and the OFF time ($T_{low}$), wherein $$(T_{high})=(R3+R4)C1\cdot\ln(2) \text{ and}$$

$$(T_{low})=R4C1\cdot\ln(2).$$

The change of the duty factor is possible both through a change of the pulse duration (switch-on duration, ON time, $T_{high}$) and also by a change in the pause duration switch-off time, OFF time, $T_{low}$).

The magnitude of the load is determined by the resistor R5 and the converter voltage $V_{CONV}$ (more precisely, the ratio $V_{CONV}$/R5).

The circuit 5 can be designed, for example, in such a manner that it is activated only during the start phase of the LED luminaire. This can be achieved, for example, in that the supply of the integrated circuit TLC 555 can by means of a time element, such as an RC element, for example, this time element be designed in such a manner that the supply for the integrated circuit TLC 555 is applied only for a time of, for example, 100 ms, and after this, because of charging up of the capacitor of the RC element, via a pre-resistor (starting from the supply voltage of the LED module 1), a specified voltage level is reached, which leads to a switching off of the supply voltage Vcc for the integrated circuit TLC555 (example not illustrated). For example, via the voltage declining in the element, the base of a switch-off transistor (not illustrated) can be controlled, which draws the supply Vcc for the integrated circuit TLC555 to ground, as soon as the RC element has been charged up. In this context, the charging time of the RC element can be designed in such a manner that a time of, for example, 100 ms is reached, wherein this time corresponds to the start phase. A start-up of the integrated circuit TLC555 at the beginning of the start phase can be implemented through a high-ohmic feed directly from the supply voltage of the LED module 1, wherein, at the end of the start phase, the latter is drawn to ground by means of the voltage declining in the RC element via the switch-off transistor in a kind of pull-down configuration. The circuit 4 can comprise a controllable switch, which adds or subtracts the resistor R5 dependent upon the output signal OUT of the integrated circuit TLC555.

The integrated circuit shown in FIG. 3 can be arranged in series with the integrated circuit shown in FIG. 6, so that the series circuit of both is arranged in parallel to the LED series on the LED module 1. By preference, the virtual ground GNDX of the integrated circuit of FIG. 6 is connected to the drain terminal of the transistor M3. A deactivation of the integrated circuit of FIG. 6 can take place, for example, in a time-controlled manner. As already explained with the example of FIG. 3, a capacitor can be arranged in parallel to the resistor R8. In this case, an RC element is also formed. The charging time of the RC element in this context can be designed in such a manner that a time of, for example, 100 ms is reached, wherein this time corresponds to the start phase. After the expiry of the start time specified by the dimensioning of the RC element, the voltage at the gate of the transistor 4 has reached a threshold voltage of the transistor M4, so that the latter closes and deactivates the transistor M3, by setting the gate voltage of the transistor M3 to ground. In this manner, the circuit of FIG. 6 can be activated only for a predetermined start phase.

If a repeatedly varying load change (that is, a modulated load change) is generated and output by the circuit 4, for example, two different items of information can also be transmitted. For example, both the frequency and also the duty factor of the load change can be varied. In this case, a first information (for example, the set voltage) could be transmitted, coded by means of the frequency, while a second information (for example, the set current) could be transmitted, coded via the duty factor. A further possibility for the combined transmission of at least two items of information would be the corresponding change in the pulse duration (switch-on duration, ON time, $T_{high}$) and the pause duration switch-off duration, OFF time, $T_{low}$) of the load change.

Figure 7:
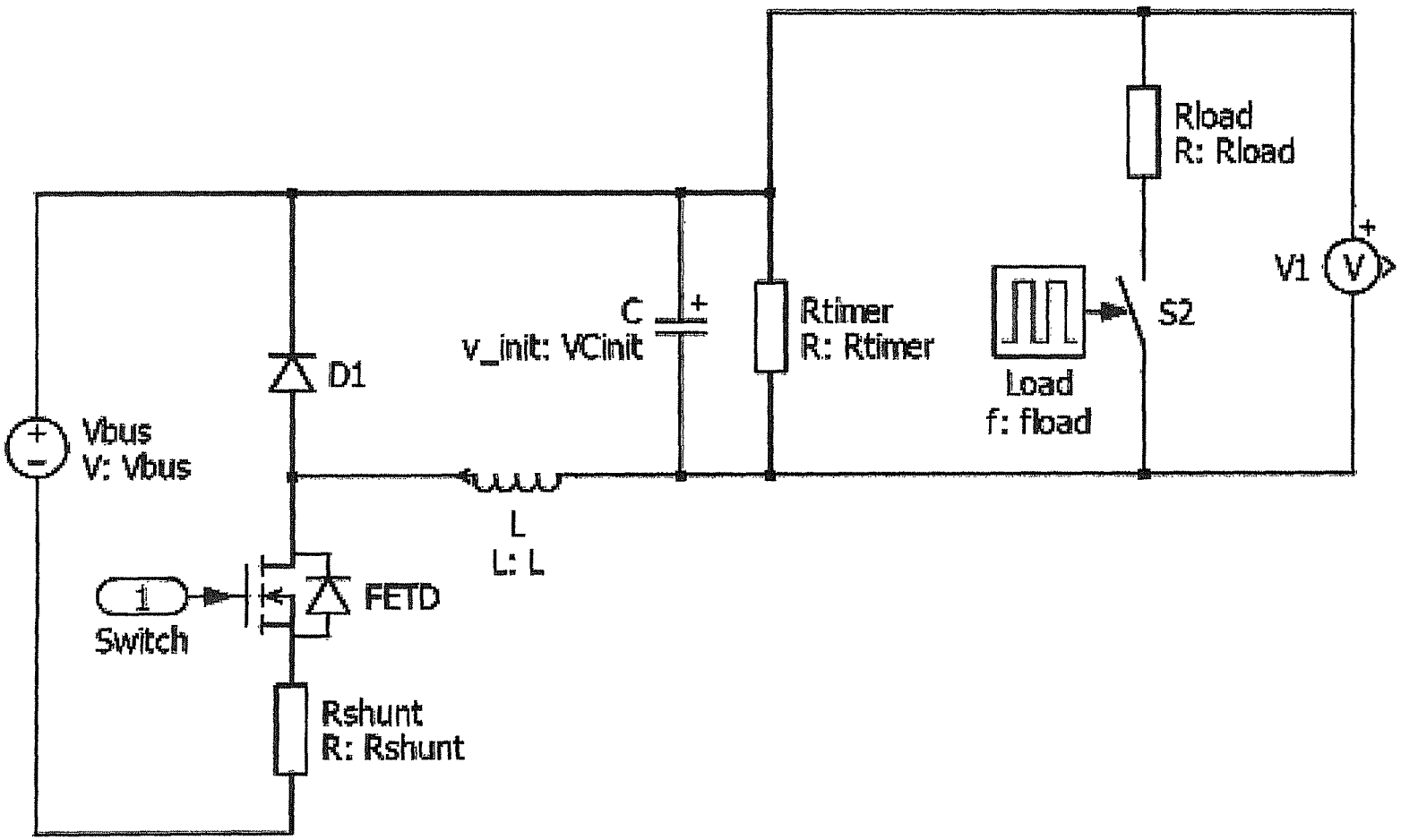
FIG. 7 shows how a change in the power consumption of the LED module according to the invention can be measured in a buck converter as an example of an LED converter according to the invention.
Figure 8:
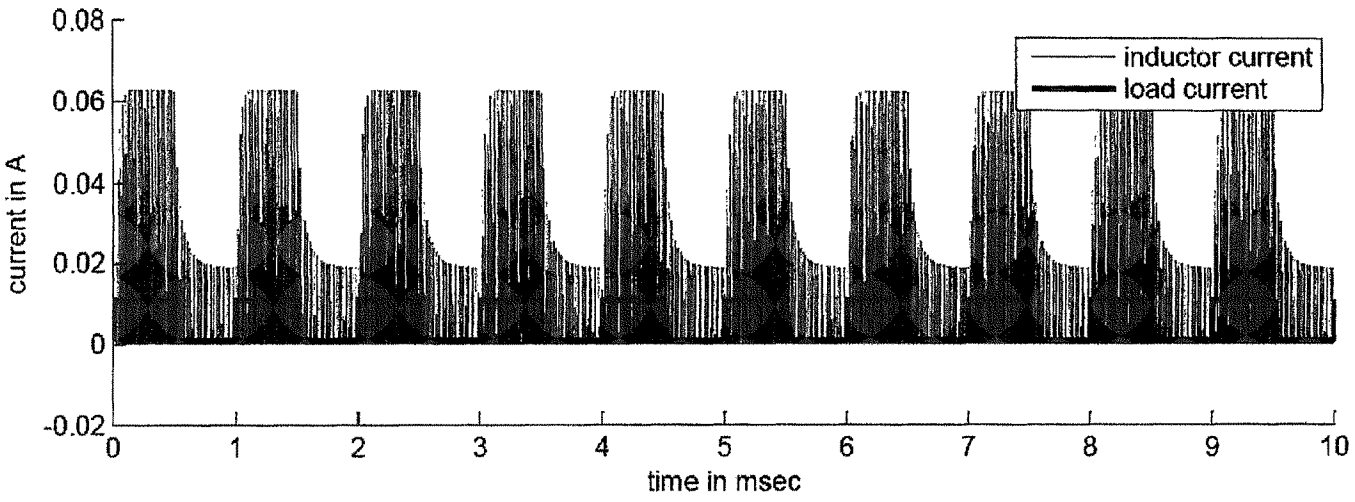
FIG. 8 shows how a change of the current through the circuit on the LED module according to the invention correlates with the current in a buck converter of the LED converter according to the invention.
Figure 8:
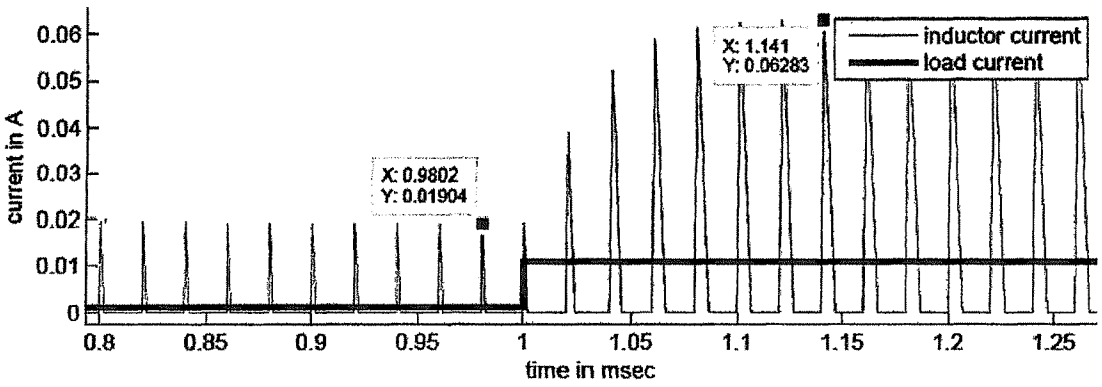

The change in the power consumption of the LED module 1 can be determined by the LED converter 10, for example, by direct current measurement of the current through the circuit 4. Alternatively, the LED converter 10 can implement measurements in a buck converter as shown in FIG. 7, wherein the buck converter is preferably a part of the LED converter M. For example, FIG. 8 shows how the current through the circuit 4 and the current in the buck converter which is measured via a shunt, correlates. FIG. 8, at the top, shows the current "load current" through circuit 4 and the current "inductor current" through the buck converter plotted against time. In this context, the buck converter constitutes only an exemplary instance of a high-frequency clocked converter, alternatively, for example, an isolated flyback converter, boost converter (step-up converter) or a resonant half-bridge converter preferably isolated, for example, an LLC converter) can be used for feeding the LED module 1.

As shown in FIG. 7, the LED converter can comprise a buck converter. The buck converter can be operated as constant-current source, that is, controlling to a constant output current. In this case, for example, the output voltage of the buck converter, that is, the voltage which is output at the output of the LED converter 10 and which corresponds to the voltage across the LED module 1, can be registered and evaluated. Additionally, or alternatively, the duration of the switch-on time and the switch-off time of the control of the high-frequency clocked switch of the buck converter can be monitored and evaluated in order to detect a load change and therefore to read out an information from the LED module 1.

The buck converter can also be operated as a constant-voltage source, that is, controlling at a constant output voltage. In this case, a load change in the LED module 1 will lead to a change of the peak current to be adjusted through the high-frequency clocked switch during the switch-on the phase of the high-frequency clocked switch of the buck converter, wherein this change can be registered. Additionally, or alternatively, the duration of the switch-on time and of the duty factor of the control of the high-frequency clocked switch of the buck converter can also be monitored and evaluated in order to detect a load change and accordingly to read out an information from the LED module 1. Alternatively, in the case of an operation as constant-voltage source, the level of the output current can also be evaluated in order to detect a load change.

The buck converter can be operated with a fixed duty factor at a fixed frequency, preferably in a continuous conduction operating mode (continuous conduction mode). With an operation of this kind, the level of the output current and/or output voltage can be evaluated in order to detect a load change.

The buck converter of the LED converter 10 can supply the LED module 1 with a constant supply voltage, preferably a constant DC voltage, for example, in a start phase. In this case, the buck converter is operated as a constant-voltage source in the start phase. For example, the LED converter 10 can be operated with reduced switch-on ratio by comparison with normal operation, thereby reaching a reduced output voltage. In this context, the supply voltage can be a first supply voltage 5*a*, that is, it can be disposed within the readout window, which is shown in FIG. 2. The buck converter can also supply the LED module 1 with a controlled current in a start phase, the buck converter is then preferably operated as a constant-current source.

FIG. 8, at the bottom, shows an enlarged view of this characteristic. The greater the load of the circuit 4, the greater a duty factor or a peak current in the measurement resistor (shunt) will be. Dependent upon a control principle of the LED module 1 through the LED converter 10, a peak-current can also be measured in the shunt of the buck converter or also a change in the duty factor in the buck converter. The change in the load of the circuit 4 or respectively the power consumption of the LED module 1 can be registered directly in the shunt at the low-potential switch of the buck converter. Either through a periodic change of the duty factor or a periodic change of the peak-current, which correlates with a periodic change in the power consumption of the LED module 1.

As already mentioned, the LED converter 10 can comprise, for example, an isolated converter with a transformer for the high-frequency energy transmission (isolated, preferably an isolated flyback converter) for the supply of the LED module 1. If the LED converter 10 is embodied in an isolated manner (for example, as an isolated flyback converter), and therefore comprises a transformer, the registration of the load change through the LED converter 10 can also take place on the primary side of the LED converter 10.

For example, the current on the primary side of the LED converter 10, which flows through the primary side of the transformer, can be registered with the use of an isolated flyback converter. In this context, for example, the current through the clock switch, which is arranged in series with the primary winding of the transformer, but also the current through the primary winding of the transformer, can be registered, preferably, by means of a shunt (current-measuring resistor) connected in series to the latter. For example, the applied load or also the load change of the LED module 1 and therefore, for example, a change in the duty factor on the primary side of the LED converter 10 can be measured on the basis of the peak-current in the shunt. For example, the change in the primary-side current against time can also be registered. For example, a registration of the power transmitted from the primary side can be implemented on the basis of the measurement of the primary-side current and a measurement or at least the knowledge of the voltage feeding the converter. It would be possible, for example, for an active power-factor correction circuit, such as a step-up circuit to be connected upstream of the converter, which delivers the input voltage for the high-frequency clocked, isolated converter, for example, the isolated flyback converter and controls it to a specified value. This specified value for the input voltage controlled by the active power-factor correction circuit for the high-frequency clocked converter is known on the basis of the specification (for example, via a voltage splitter) and can therefore be taken into consideration in registering the power transmitted from the primary side.

As already mentioned, the LED converter can comprise an isolated flyback converter (flyback converter). The isolated flyback converter can be operated as a constant-current source, that is, controlling to a constant output current. In this case, for example, the output voltage of the isolated flyback converter, that is, the voltage which is output at the output of the LED converter 10 and corresponds to the voltage across the LED module 1, can be registered and evaluated. This output voltage can be registered directly or also indirectly, for example, by means of a measurement of the voltage in a primary-side winding of the transformer of the isolated flyback converter. Additionally, or alternatively, the duration of the switch-off time of the control of the high-frequency clocked switch of the isolated flyback converter can be monitored and evaluated in order to detect a load change and accordingly to read out an information from the LED module 1.

The isolated flyback converter can also be operated as a constant-voltage source, that is, controlling to a constant output voltage. In this case, a load change in the LED module 1 will lead to a change of the output current, wherein this change can be registered. This change of the output current can lead, for example, to a change of the peak current to be adjusted through the high-frequency clocked switch during the switch-on phase of the high-frequency clocked switch of the isolated flyback converter. The monitoring of the primary-side current through the high-frequency clocked switch can therefore be exploited for the monitoring of a load change in order to read out an information from the LED module 1 in this manner.

The isolated flyback converter can also be operated with a fixed duty factor at a fixed frequency. In the case of such an operation, the level of the output current and/or the output voltage can be evaluated in order to detect a load change. If only the LED series of the LED module is active, the output voltage will assume the value of the let-through voltage of the series. If a load change through the circuit 4 takes place, the output voltage will decline. This change can be registered as a load change.

As already mentioned, the LED converter can comprise an isolated, resonant half-bridge converter, such as a so-called LLC converter. The converter can be operated as a constant-current source, that is, controlling at a constant output current. In this case, for example, the output voltage of the isolated flyback converter, that is, the voltage which is output at the output of the LED converter 10 and corresponds to the voltage across the LED module 1, can be registered and evaluated. This output voltage can be registered directly or also indirectly, for example, by means of a measurement of the voltage at a primary-side winding of the transformer of the LLC converter. If only the LED series of the LED module is active, the output voltage will assume the value of the let-through voltage of the LED series. If a load change through the circuit 4 takes place, the output voltage will decline. This change can be registered as a load change. Additionally, or alternatively, the clock frequency of the LLC converter adjusted on the basis of the control loop can also be monitored and evaluated in order to detect a load change and therefore to read out an information from the LED module 1. If the control loop of the LLC converter is designed in such a manner that, in the case of the load change through the circuit 4, a frequency stop of the control of the half bridge of the LLC converter is reached, this can also be evaluated in order to read out the information.

The isolated, resonant half-bridge converter, for example, LLC converter, can also be operated as a constant-voltage source, by operating it at fixed frequency, wherein the frequency is selected in such a manner that the resulting voltage at the output is disposed below the value of the let-through voltage of the LED series. In this case, a load change in the LED module 1 will lead to a change in the output current, wherein this change can be registered. This change in the output current can take place, for example, on the secondary side of the LLC converter and can be transmitted to the primary side by means of a coupling element, such as a current transformer. The monitoring of the output current can therefore be exploited for the monitoring of a load change, in order to read out an information from the LED module 1 in this manner.

The LED converter 10 is operated, for example, in a start phase, in a given mode, for example, in a fixed-frequency mode, or alternatively, also operated as current source or voltage source in order to detect a load change and accordingly to read out an information of the circuit 4, which is transmitted, for example, according to at least one protocol.

The circuit 4 can also comprise a digital control unit IC1, which is designed to output different types of modulated signals as preferably modulated load change, for example, also a given pulse sequence as digital coding (sequence of zeros and ones). The converter 10 can be designed to interrogate different types of information, that is, different operating parameters and/or maintenance parameters, from the LED module 1 through a change of the supply voltage, and also to interrogate selectively one of several LED modules. The change in the supply voltage can take place, for example, by means of a low-frequency (within the range of a few Hz up to one kHz) or high-frequency modulation (within the range of several tens or hundreds kHz or up to the megahertz range).

The digital control unit IC1 of the circuit 4 can be embodied as an integrated circuit. For example, the integrated circuit can be embodied as an integrated control circuit with only three or four connections.

Figure 9:
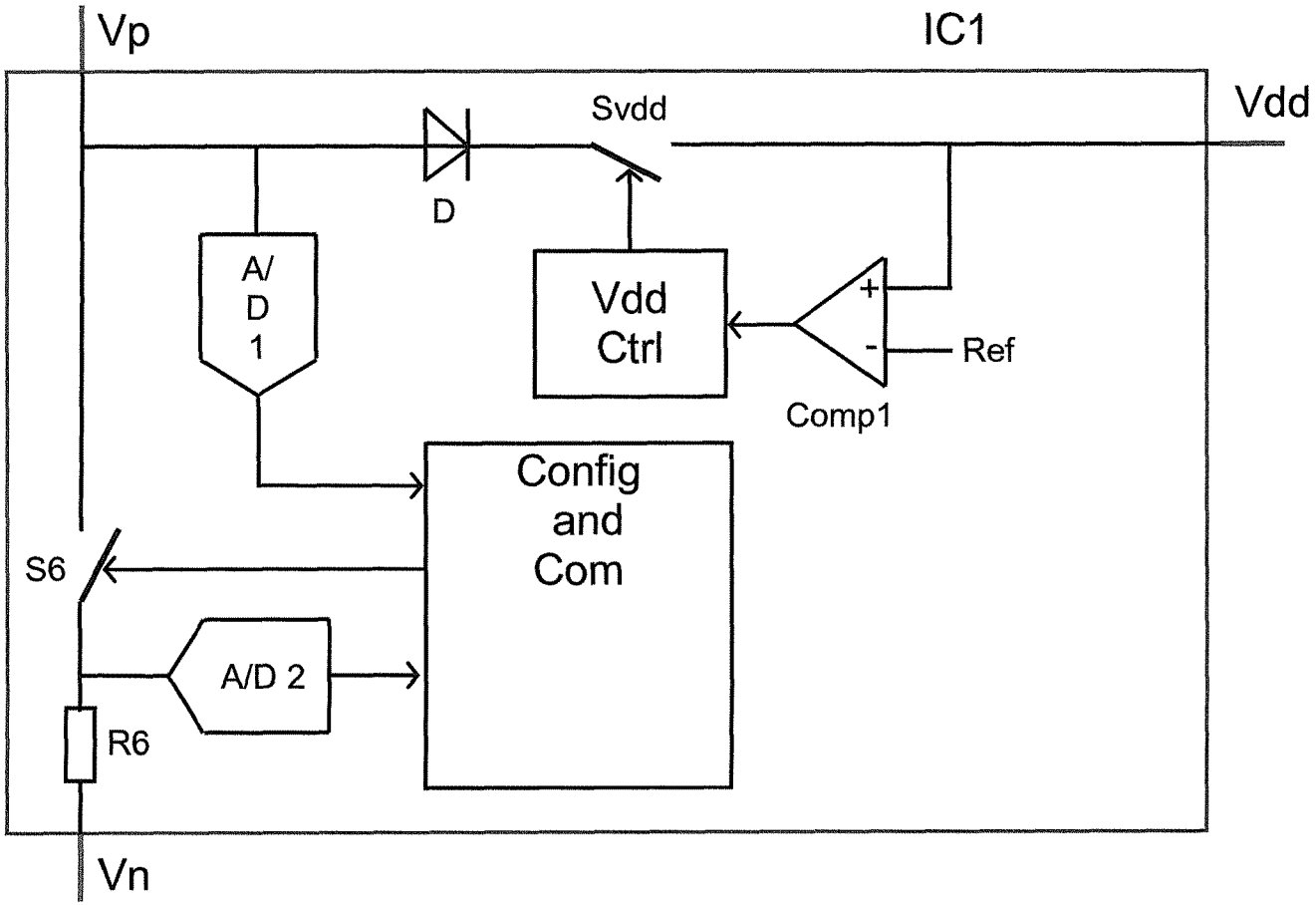
FIG. 9 shows a further example of the circuit on the LED module according to the invention.

In an embodiment with three connections, the digital control unit IC1 would have a first connection Vp, which is connected to the supply voltage of the LED module 1 (FIG. 9). Via this first connection Vp, the digital control unit IC1 can register the supply voltage of the LED module 1 by means of the first analog-digital converter A/D1 connected to this connection Vp. A second connection Vn is connected to the ground of the LED module 1 and allows an internal ground connection within the digital control unit IC1. A third connection Vdd can be connected to a capacitor, which is also connected to the ground of the LED module 1 with its other connection. The second connection Vp can be connected internally via a diode and a switch Svdd to the first connection Vp. This switch Svdd can be compared, dependent upon a comparison of the current voltage present at the connection Vdd, with a reference value Ref by means of a comparator Comp1. Dependent upon the result of the comparison, the switch Svdd can be switched on by the driver unit VddCtrl, when the actual value of the voltage at the at the connection Vdd is smaller than the reference value Ref. A current then flows via the switch Svdd into the capacitor which is connected to the third connection Vdd. The voltage present at the third connection Vdd can be used as an internal voltage supply for the digital control unit IC1. In this case, the connection Vdd serves to stabilise the internal voltage supply of the digital control unit IC1.

According to this example, the digital control unit IC1 can be programmed in advance, for example, during the manufacture or fitting of the LED module 1. This programming of the digital control unit IC1 can specify, for example, an operating parameter of the LED module 1, such as a set current or the set voltage.

In the digital control unit IC1, a switch element S6 is integrated, which corresponds in function to the switch 6 in the example of FIG. 1 and is designed to output at least one modulated signal or also different types of modulated signals, preferably as modulated load change. In this context, the voltage at the first connection Vp is connected internally by closing the integrated switching element S6, directly or indirectly to the second connection Vn, for example, via an integrated resistor R6, and therefore draws the voltage at the connection Vp to a lower potential. For example, the modulated signal can be a given pulse sequence and can be output as digital coding (sequence of zeros and ones). By means of the switch element S6, the digital control unit IC1 can therefore communicate an information, for example, in a start-up phase (that is, a time-limited start phase of the LED converter and LED module 1), preferably according to the at least one protocol, which is stored in the LED module 1 and in the LED converter 10. The current through the switching element S6 can be monitored by means of the resistor R6, wherein the switching element S6 can be opened if the current through the switching element S6 and accordingly the resistor R6 becomes too large. The registration of the voltage declining across the resistor R6 and accordingly of the current flowing through it, can be implemented by means of a second analog-digital converter A/D2. The reading out and evaluation of the two analog-digital converters and the control of the switch element S6 can be implemented through a control block "Config and Com" integrated in the digital control unit IC1. All further operations, such as signal evaluations and outputs, can also be implemented through this control block.

In the digital control unit IC1, for example, a sensor unit for the registration of the temperature can, for example, also be integrated, wherein the digital control unit IC1 can communicate an over-temperature or an operating temperature to the LED converter as a maintenance parameter, as information according to the at least one protocol. As maintenance parameter, the digital control unit IC1, can, for example, also comprise a counter for the operating time, and the digital control unit IC1 can be designed for this purpose to output as maintenance parameter an ageing parameter of the LED module or respectively of the LED series, or an operating duration of the LED module.

The digital control unit IC1 can also register an overvoltage in the LED module 1 and output a corresponding error message as maintenance parameter. Optionally, or alternatively, by closing the switching element S6, the LED series of the LED module 1 can be bridged and therefore protected from the overvoltage.

Figure 10:
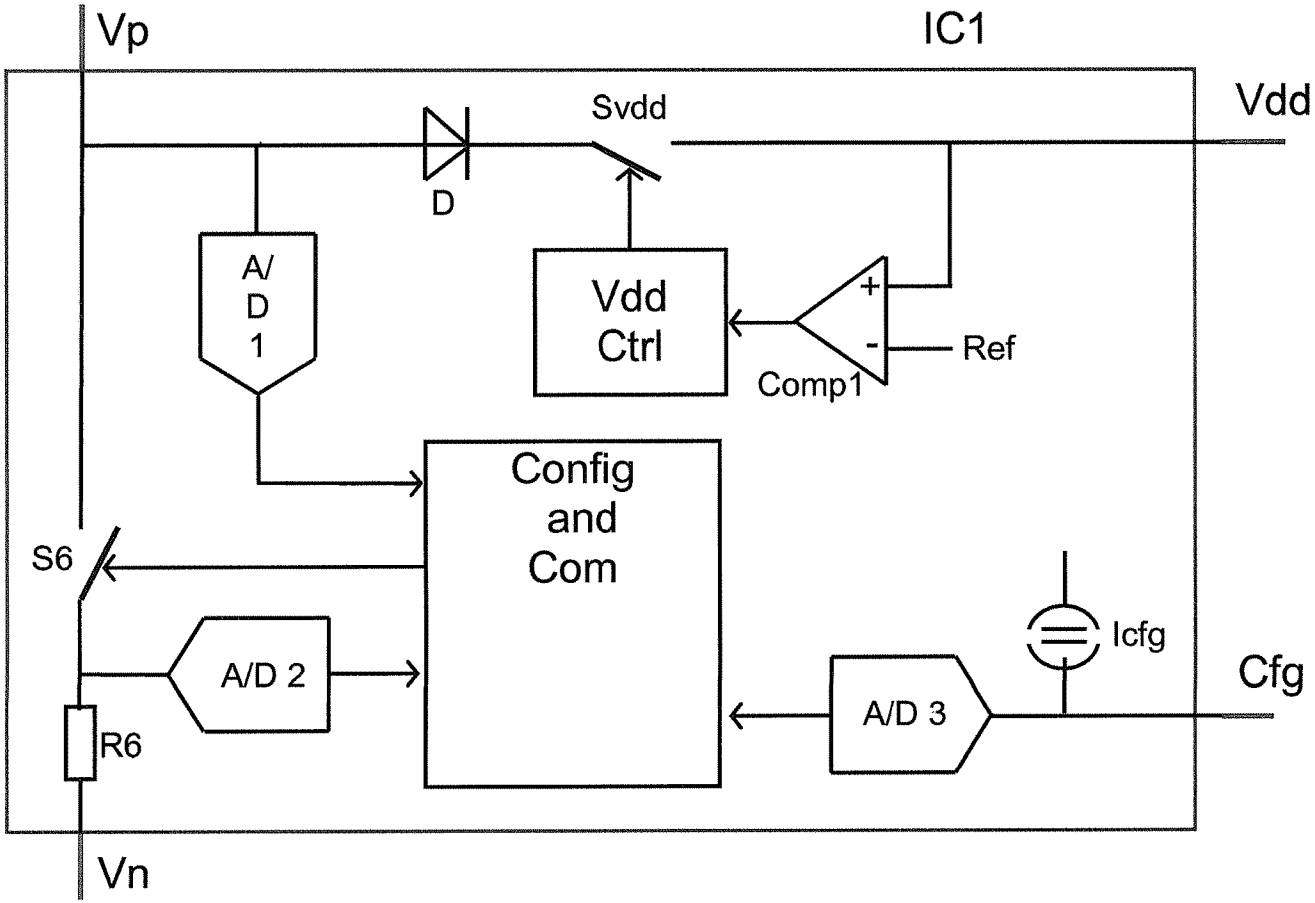
FIG. 10 shows a further example of the circuit on the LED module according to the invention.

FIG. 10 shows an embodiment of the digital control unit IC1 with four connections. The digital control unit IC1 comprises a fourth connection Cfg, at which a configuration element, such as a resistor Rcfg (selection resistor R11) can be connected. A controllable current source Icfg can be connected internally to this fourth connection Cfg. The voltage declining across the resistor Rcfg, which is obtained on the basis of the current fed in through the controllable current source Icfg and the resistance value of the resistor Rcfg, can be registered by the control block "Config and Com" of the digital control unit IC1 via a third analog-di tat converter A/D3. This registered voltage at the fourth connection Cfg can specify an operating parameter of the LED module 1, such as the set current or the set voltage. Optionally, for example, a temperature-dependent resistance can be arranged between the fourth connection Cfg and the third connection Vdd. The temperature-dependent resistor can be designed in such a manner that its resistance changes strongly in the case of an over-temperature on the LED module 1, so that the voltage at the fourth connection Cfg also changes. This change can be registered by the digital control unit IC1, and, for example, as a maintenance parameter, an over-temperature can be communicated to the LED converter as information according to the at least one protocol. For example, an NTC can be used as temperature-dependent resistor, which lowers its resistance at an excessively high temperature, so that the voltage at the fourth connection Cfg rises. The controllable current source Icfg can be active, for example, only at the start of the digital control unit IC1, in order to read out the value of the resistor R11, while, in continuous operating mode of the LED module 1, only the voltage resulting across the voltage splitter, comprising the temperature-dependent resistor and resistor R11, is monitored for the detection of an over-temperature.

Figure 11:
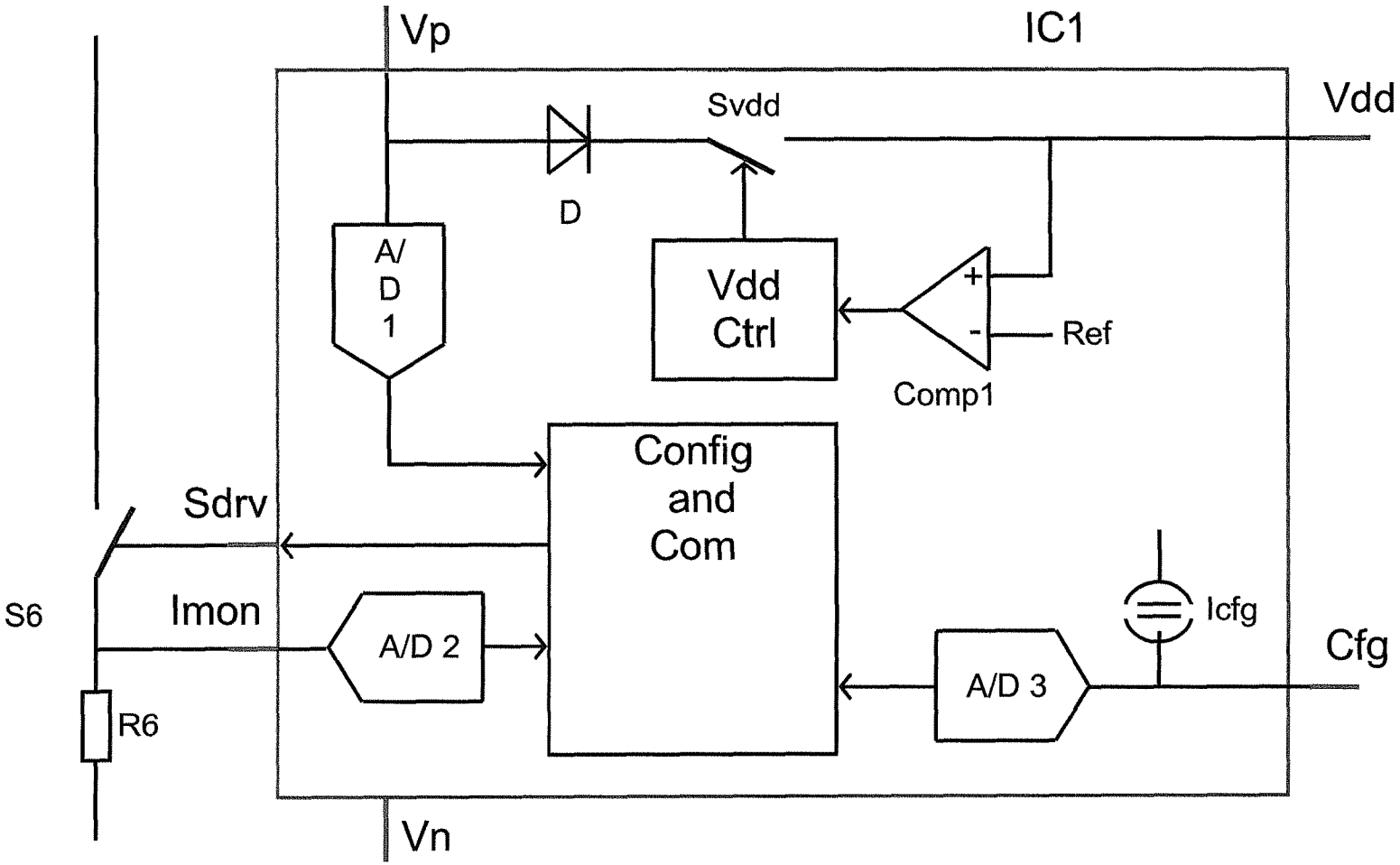
FIG. 11 shows a further example of the circuit on the LED module according to the invention.

By way of difference from the examples of FIGS. 9 and 10, in this variant of FIG. 11, the switch is embodied not as an integrated switch element S6 but as an external switch 6 analogous to the example from FIG. 1. This switch 6 is controlled via a fifth connection Sdrv by the digital control unit IC1. A resistor R6 is arranged in series with the switch 6. The current through the resistor R6 can be registered and monitored by the digital control unit IC1 on the basis of the voltage declining across the resistor R6 by means of a sixth connection Imon.

Figure 12:
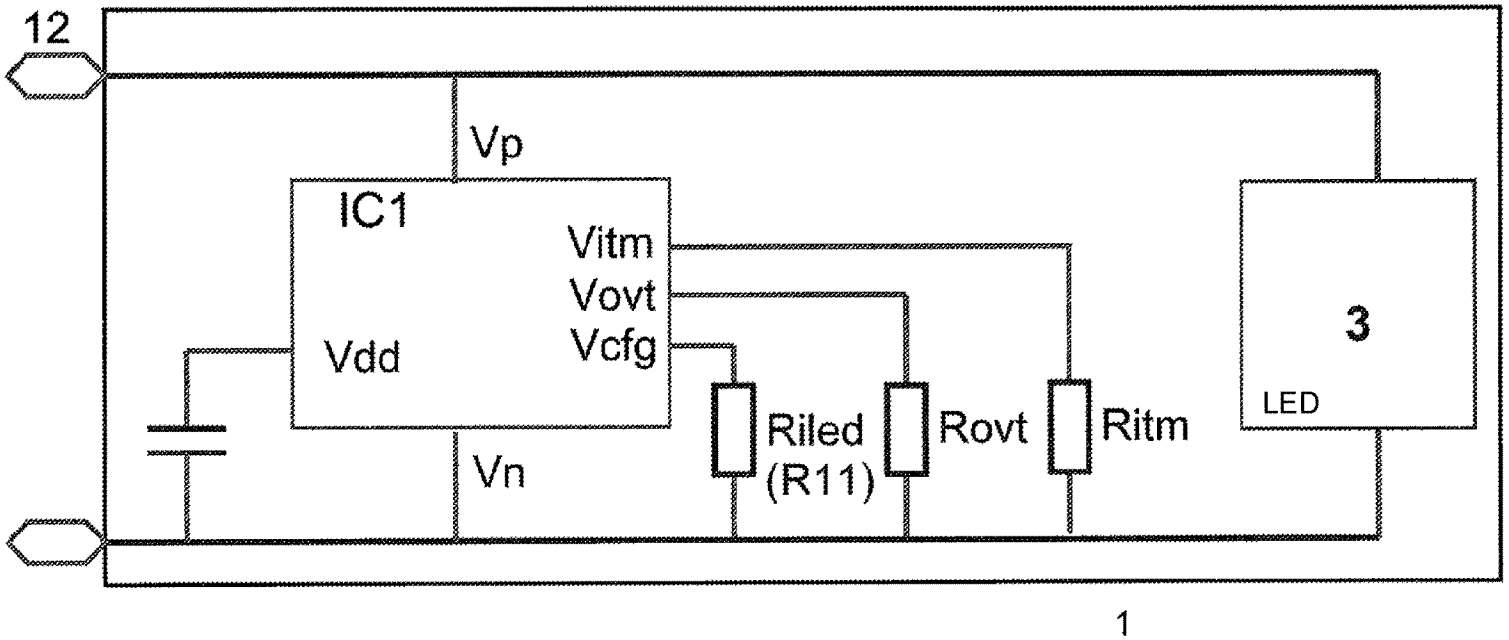
FIG. 12 shows a further example of the circuit on the LED module according to the invention.

The example of FIG. 12 shows a further embodiment of the digital control unit IC1. This example, like the example of FIG. 10, comprises the connections Vp, Vn and Vdd. The fourth connection Cfg is also present, to which, once again, a resistor R11 (Riled) is connected as configuration element. Furthermore, the digital control unit IC1 comprises two further connections. At one further connection Vovt, a resistor Rovt is connected, which is a temperature-dependent resistor. By monitoring the resistance value of this resistor Rovt, an over-temperature can be detected. Accordingly, a further controllable current source can be arranged in the digital control unit IC1, which flows into the resistor Rovt. Dependent upon the current resistance value, which is monitored on the basis of the voltage registered at this connection Vovt, the digital control unit IC1 can infer an over-temperature on the LED module 1. In analogous manner, via a further controllable current source at the further connection Vitm, a current can be fed into the temperature-dependent resistor Ritm connected to the latter, and the digital control unit IC1 can infer the operating temperature on the LED module 1 from the current resistance value, which is monitored on the basis of the voltage registered at this connection Vitm. Dependent upon the value of the operating temperature registered, the latter can be communicated as information exactly in the same manner as an over-temperature can be communicated to the LED converter as information according to the at least one protocol. The information about the operating temperature can be evaluated by the LED converter, wherein an intelligent feedback control of the current through the LED module 1 can take place, without an over-temperature having to be reached.

The switch 6 or respectively the switch element S6 can perform further functions on the LED module 1, which can be controlled by the digital control unit IC1. For example, an after-glow protection can be allowed. For example, the digital control unit IC1 can detect when the LED module 1 is to be switched off or has already been switched off through the disconnection of the supply voltage. In order to avoid voltages coupled in through parasitic effects or remaining residual charges, the switch 6 or respectively the switch element S6 can be closed in order to avoid a glowing of the LED on the basis of the coupled voltages. Alternatively, or additionally, a protection of the LED module 1 from over-voltages can be achieved, in that, in the case of overvoltage, the switch 6 or respectively the switch element S6 at the supply input of the LED module 1 is at least briefly closed, in order to reduce the overvoltage or respectively protect the LED. In this manner, a protection from over-voltages can be achieved in the case of the separation of the LED module 1 from the LED converter in the operation of the LED module 1, as a so-called "hot-plug" protection. Such a separation can occur both accidentally through a sudden interruption of contact in the supply line, or also through a user error through an intervention, for example, a change of the LED module 1 during operation.

In a communication mode, the LED converter can cause a change of the LED module through a selective change of the supply voltage for the LED module 1, and the LED converter 10 can then register the change in the power consumption of the LED module 1 and decode it according to the at least one protocol, which is stored, for example, in the LED module 1 and in the LED converter 10. For example, in this manner, the LED converter 10 can request different information from the LED module 1, wherein a specific protocol can be stored for every request. Accordingly, without additional lines or pins, a bidirectional communications path between the LED module and the LED converter is made possible.

The change in the power consumption of the LED module 1 can be caused dependent upon a value of the first supply voltage 5*a* according to one of several specified protocols and accordingly, a different load change can be caused according to one of several specified protocols.

Three concepts for the registration of the change in power consumption of the LED module 1 through the LED converter 10 are preferred by the present invention. Firstly, the determination of a constant-current load, wherein the constant current can be measured, for example, via a discharge rate of the capacitor in the LED converter 10. Secondly, through determination of a frequency of the change in power consumption of the LED module 1, for example, through direct registration of the current on the converter side. And finally, through indirect registration by means of determining a peak-current within the LED converter, which comprises, for example, an isolated flyback converter or buck converter, which is measured across a shunt. The peak-current follows the change in power consumption of the LED module 1.

In summary, the present invention proposes the communication of information from an LED module 1 to an LED converter 10, which allows an inference to be made regarding operating and/or maintenance parameters to be set in the LED module 1. The operating parameters to be set can be, for example, the set current or the set voltage. For this purpose, a circuit 4 (load-modulation circuit) is provided according to the invention on the LED module, which, for example, within a voltage range of a first supply voltage 5*a*, which is not equal to zero and at which an LED series 3 connected to the LED module 1 is not conductive, constitutes a load for the LED converter, and, within a voltage range of a second supply voltage 5*b*, which is not equal to zero and in which a connected LED series 3 is conductive, does not constitute a load for the LED converter 10. The circuit 4 can also be activated only at times, preferably only during a start phase of the LED luminaire. The load can be constant or variable in a repeated manner (modulated), for example, according to a specified protocol.

For instance, a modulated load change can take place, for example, according to a specified protocol. The power consumption can be registered by the LED converter 10, especially also a change in the power consumption (amplitude, frequency, duty factor). As a result, the LED converter 10 can determine the operating and/or maintenance parameters. The communication of this information between the LED module 1 and the LED converter 10 requires no additional connections (only the connection of the supply voltage). Furthermore, no interaction with LED module 1 and/or LED converter 10 is necessary. As a result, the disadvantages of the known prior art are improved.

The invention claimed is:

1. An LED module (1) comprising:

voltage connections (12);

connections (2) for an LED series (3);

a circuit (4) which is configured and arranged to constitute:

a variable current at the volts, e connections (12) when a first supply voltage (5*a*) not equal to zero is applied to the voltage connections (12) of the LED module (1), the first supply voltage (5*a*) being dimensioned in such a manner that, in a case of a connection of an LED series (3), the latter is not conductive, wherein the variable current load effects a change in a power consumption of the LED module (1) according to a specified protocol, and no load when a second supply voltage (5*b*) not equal to zero is applied to the voltage connections (12) of the LED module (1), at which, in the case of connection of the LED series (3), the latter is conductive and light is emitted, wherein the type of the load constituted by the circuit (4) is selected dependent upon the value of the first supply voltage and/or of a modulation of the first supply voltage, wherein a voltage range of the first supply voltage (5*a*) is subdivided into a plurality of sub-ranges and wherein each sub-range corresponds to a different specified protocol wherein, for each of the plurality of sub-ranges, the circuit (4) is configured to effect a change of the variable current load dependent on a value of the first supply voltage (5*a*) according to the specified protocol, of the sub-range, wherein for each sub-range a different change of the power consumption of the LED module (1) is present.

2. The LED module (1) according to claim 1, wherein the circuit (4) is designed to code at least one operating and/or maintenance parameter of the LED module (1) through a change in the power consumption of the LED module.

3. The LED module (1) according to claim 1, wherein the at least one specified protocol specifies a frequency and/or an amplitude and/or a duty factor of a change in the power consumption of the LED module (1).

4. The LED module (1) according to claim 1, wherein the circuit (4) comprises a timer circuit (6), which is designed to specify a frequency of the change in a power consumption of the LED module (1).

5. The LED module (1) according to claim 1, wherein the circuit (4) is integrated in a semiconductor material of the LED module (1).

6. The LED module (1) according to claim 1, wherein at least one sensor is provided on the LED module (1), which is designed to influence an electrical parameter of the circuit (4).

7. The LED module (1) according to claim 6, wherein the at least one sensor is a light sensor with light-dependent resistance, and the light sensor is connected to the circuit (4) in such a manner that a change of the light-dependent resistance changes the load resistance of the circuit (4).

8. An LED converter (10) in combination with the LED module (1) according to claim 1, wherein the LED converter (1) comprises a high-frequency clocked converter, wherein the high-frequency clocked converter is configured and arranged to selectively match the supply voltage of the LED module and is designed, to register the power consumption of the LED module (1) on the primary side of the transformer of the high-frequency clocked converter, and, based on the registered power consumption, to determine at least one operating and/or maintenance parameter of the LED module (1).

9. The LED converter (10) according to claim 8, which is designed to use the at least one determined operating and/or maintenance parameter:

for the adjustment or control of the operation of the LED module (1), to store it in an associated memory/store, to display it visually and/or acoustically, and/or to transmit it via a wireless or tethered interface, optionally upon request from externally.

10. The LED converter (10) according to claim 8, wherein the at least one operating and/or maintenance parameter is a set current through an LED series (3) connected to the LED module (1), an ageing parameter, an operating duration, and/or a spectrum of a light emitted by the LED series (3).

11. The LED converter (10) according to claim 8, which is designed to identify the LED module (1) based upon the at least one determined operating and/or maintenance parameter.

12. The LED converter (10) according to claim 8, which is designed, through adjustment of a first supply voltage (5*a*) or a second supply voltage (5*b*), for the LED module (1), to switch selectively between a mode for the registration of a power consumption of the LED module (1) and a mode for the lighting operation of an LED series (3) connected to the LED module (1).

13. The LED converter (10) according to claim 8, which is designed to implement a current measurement for the direct registration of the power consumption of the LED module (1).

14. The LED converter (10) according to claim 8, which is designed to implement an indirect registration of the power consumption of the LED module (1).

15. The LED converter (10) according to claim 14, which is designed to register a change in the power consumption of the LED module (1) through a change in a duty factor of a clocking of the LED converter (10).

16. The LED converter (10) according to claim 8, which is designed to discharge a capacitor (11) via a load of the LED module (1), to determine a discharge current of the capacitor (11) directly, or indirectly via a discharge time, and to determine the at least one operating and/or maintenance parameter of the LED module (1) based on this discharge current.

17. A method for determining information regarding an LED module (1) according to claim 1 performed by an LED converter (10) wherein the LED converter (10) comprises a high-frequency clocked converter, the method comprising:

applying the first supply voltage (5*a*) not equal to zero to the LED module (1), wherein the first supply voltage (5*a*) is dimensioned in such a way that in case of the connection of the LED series (3), the latter is not conductive, registering the power consumption of the LED module (1) by the high-frequency clocked converter, wherein the circuit (4) on the LED module (1) causes a modulated load change during a start phase, and determining at least one operating and/or maintenance parameter of the LED module (1) based on the registered power consumption.

* * * * *